US010600633B1

(12) United States Patent
Jelic

(10) Patent No.: US 10,600,633 B1
(45) Date of Patent: Mar. 24, 2020

(54) GAS DISCHARGE LAMP

(71) Applicant: JELIGHT COMPANY, INC., Irvine, CA (US)

(72) Inventor: Marinko Jelic, Irvine, CA (US)

(73) Assignee: Jelight Company, Inc., Irvine, CA (US)

( * ) Notice: Subject to any disclaimer, the term of this patent is extended or adjusted under 35 U.S.C. 154(b) by 0 days.

(21) Appl. No.: 16/354,560

(22) Filed: Mar. 15, 2019

(51) Int. Cl.
*H01J 61/30* (2006.01)
*H01J 61/067* (2006.01)

(52) U.S. Cl.
CPC ..... *H01J 61/302* (2013.01); *H01J 61/0675* (2013.01)

(58) Field of Classification Search
None
See application file for complete search history.

(56) References Cited

U.S. PATENT DOCUMENTS 4,182,975 A * 1/1980 Young ..... H01J 61/103 313/485
RE33,415 E * 10/1990 Jelic ..... H01J 61/103 313/609
4,965,484 A * 10/1990 Fein ..... H01J 61/52 313/15
5,610,477 A * 3/1997 Ivanov ..... H01J 17/30 313/234
5,821,681 A * 10/1998 Wynn ..... H01J 61/36 313/318.01

* cited by examiner

*Primary Examiner* — Ashok Patel
(74) *Attorney, Agent, or Firm* — Smyrski Law Group, A P.C.

(57) ABSTRACT

The present design includes a gas discharge lamp having a base, a closed top cylindrical envelope fixedly mounted to the base, the closed top cylindrical envelope comprising an integrally formed partition defining a pair of openings on opposite sides of the partition, and two electrodes positioned proximate the base, each electrode on an opposite side of the partition. Sides of the partition contact the closed top cylindrical envelope and the partition includes a notch formed proximate an upper edge of the partition thereby establishing an exclusive gas passageway between the pair of openings.

20 Claims, 7 Drawing Sheets

GAS DISCHARGE LAMP

BACKGROUND

I. Field

The present disclosure relates generally to lighting devices, and more particularly to gas discharge lamps that emit short wavelength light.

II. Background

A gas discharge lamp encases electrodes and gas within an envelope that is transparent or translucent to light. When an electrical discharge path is established between the electrodes through ionized gas, the ionized gas emits light radiation of a known frequency. This light radiation passes through the envelope and is visible or otherwise usable as a light source.

Low-pressure capillary UV lamps are commonly used in equipment such as photoionization detectors and trace gas analyzers. Capillary lamps offer two significant advantages over other light sources: they provide a highly concentrated source of UV light and a very stable electric arc. This provides the host equipment with a powerful, consistent light source that facilitates precise measurement. The concentration of UV light and high stability is achieved by flowing the electric arc from an electrode through a narrow bore quartz capillary tube and viewing the light from the end. The electric arc continues to flow through the lamp envelope to a second electrode. This flow path may or may not pass through a second narrow bore quartz capillary tube.

One example of a design for such a capillary lamp is shown by U.S. Pat. No. 4,810,924, inventor Marinko Jelic, the inventor of the present invention. The lamp shown in U.S. Pat. No. 4,810,924 includes a cylindrical quartz envelope with a circular magnesium fluoride window and two tungsten or molybdenum electrodes each sheathed in a capillary tube. A partition is provided between the electrodes and a gas discharge path produces light at the capillary tube orifices.

While capillary lamps can be relatively inexpensive to manufacture, double-bore lamps such as those shown in the '924 patent offer fewer components within the quartz body and are therefore less expensive to produce. Common applications for double-bore lamps include medical equipment, TOC (total organic carbon) analyzers, ozone generators and ozone detectors. Double-bore lamps are stable and can be used for the calibration of equipment such as spectroscopes and photometers. However, double-bore lamps can lack stability and may exhibit brightness issues, lacking the irradiance required to replace standard capillary type gas discharge lamps.

A gas discharge lamp that provides a stable light source with a relatively high level of irradiance is therefore desirable.

SUMMARY

According to one aspect of the present design, there is provided a gas discharge lamp comprising an elongate tubular envelope having an integrally formed partition extending axially from one end of the elongate tubular envelope and defining a pair of bores within an interior of the elongate tubular envelope disposed on opposite sides of the partition, a pair of electrodes, with one electrode disposed within each of the pair of bores, and an upper surface disposed at the opposite end of the elongate tubular envelope. Sides of the partition contact the elongate tubular envelope, the partition contacts the upper surface, and the partition comprises a notch formed therein, the notch contacting the upper surface and forming an exclusive passageway between the pair of bores.

According to a further aspect of the present design, there is provided a gas discharge lamp comprising a base, an envelope affixed to the base, the envelope having an integrally formed partition extending axially from one end of the envelope thereby defining a pair of bores on opposite sides of the partition within an interior of the envelope, two electrodes, the two electrodes disposed on each side of the partition, and an upper surface affixed to an end of the envelope opposite the base. Sides of the partition contact the envelope, the partition contacts the upper surface, and the partition comprises a notch formed therein, the notch contacting the upper surface and forming an exclusive gas passageway between the pair of bores.

According to another aspect of the present design, there is provided a gas discharge lamp comprising a base, a closed top cylindrical envelope fixedly mounted to the base, the closed top cylindrical envelope comprising an integrally formed partition defining a pair of openings on opposite sides of the partition, and two electrodes positioned proximate the base, each electrode on an opposite side of the partition. Sides of the partition contact the closed top cylindrical envelope and the partition comprises a notch formed proximate an upper edge of the partition thereby establishing an exclusive gas passageway between the pair of openings.

Various aspects and features of the disclosure are described in further detail below.

DETAILED DESCRIPTION

The present design combines the advantages of high irradiance and stability afforded by a capillary lamp with the benefits of simplicity and reduced cost offered by a double-bore lamp. The quartz envelope design presented is based upon a double-bore lamp design where the furthermost tip of the septum or middle divider from the electrodes is modified to provide a narrow gap for the lamp arc to pass through. The end of the lamp envelope is flattened to allow precise viewing from the end and constricts the arc to the narrow gap in the septum. The result is a lamp design that provides enhanced stability and improved irradiance over previous designs available.

Figure 1:
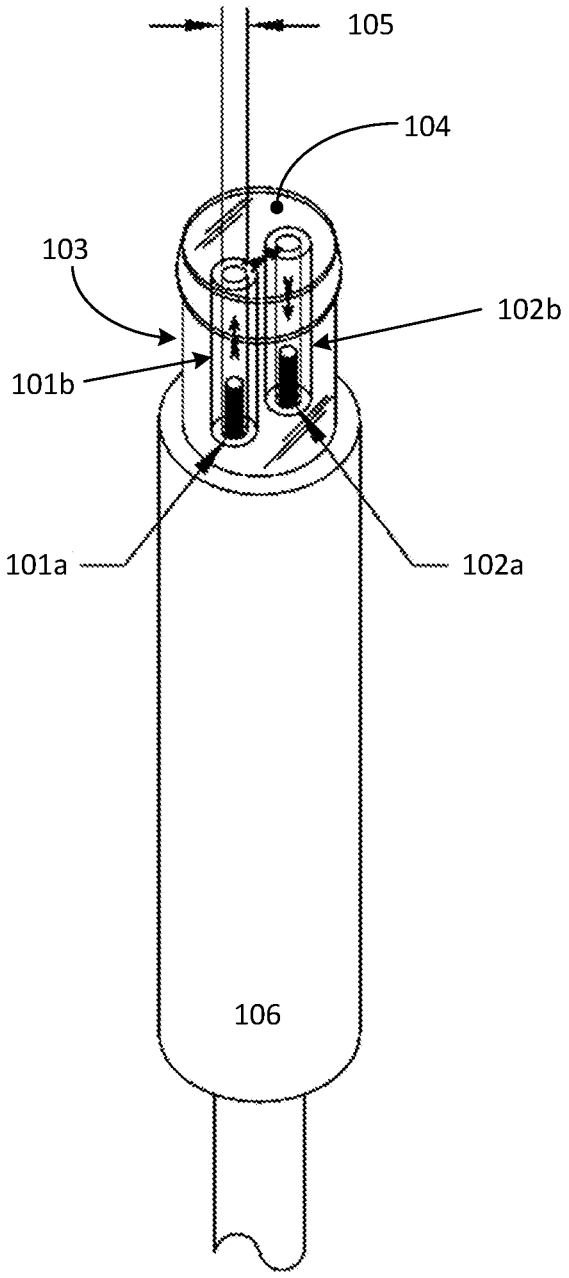
FIG. 1 (Prior Art)
FIG. 1 illustrates a standard capillary lamp.

FIG. 1 shows a standard capillary lamp including a base 106 with first electrode 101*a* and second electrode 102*a* provided. The electrodes are enclosed in capillary tubular members 101*b* and 102*b*, respectively. The two electrodes and the respective capillary tube members may be cylindrical in shape, with a surrounding cylindrical, or generally cylindrical, quartz envelope 103 having a flat, circular window 104 fabricated from magnesium fluoride, or any other transparent material, positioned above the openings or top surfaces of the two electrode capillary tube members 101*b* and 102*b*. A gap is thus formed between the top of the two electrode capillary tube members 101*b* and 102*b* and the flat, circular window 104, allowing gas and charge to pass through in the direction of the arrows shown, producing light. In the view presented in FIG. 1, a slight bulged area is provided at the top of quartz envelope 103, but the quartz envelope may be cylindrical or take other shapes. Dimension A 105 in FIG. 1 represents the diameter of electrode capillary tube member 101*b* and represents the area where the arc is concentrated by the narrow quartz capillary tubing.

Figure 2:
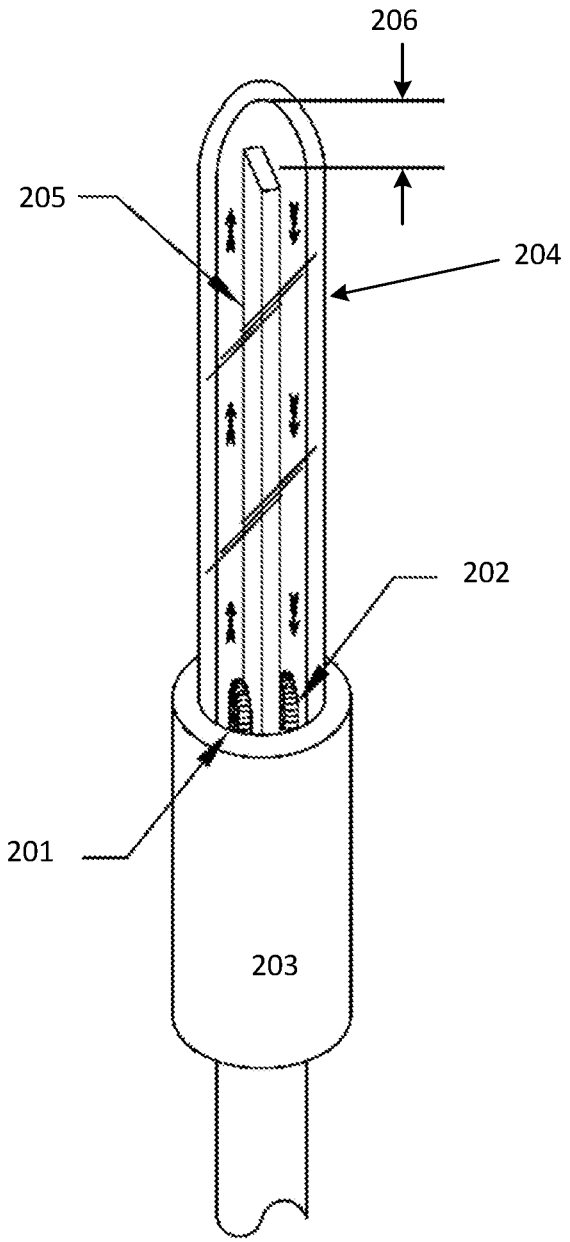
FIG. 2 (Prior Art)
FIG. 2 is a representation of a double-bore lamp.

FIG. 2 illustrates an example of a double-bore lamp. In this view, first electrode 201 and second electrode 202 are shown in base 203 with tube 204 provided. Tube 204 typically has a rounded top as shown. Between electrodes 201 and 202 is partition or septum 205, with dimension B 206 representing the gap formed between septum 205 and the inner top of tube 204. Dimension B 206 is typically greater than Dimension A in FIG. 1. As shown in FIG. 2 by the arrows provided, electrical discharge flows up from electrode 201, around septum 205, and to electrode 202, thus producing light. The septum in FIG. 2 may or may not touch the inner walls of the tube provided.

A major issue with the design of FIG. 2 is stability. Electrical discharge propagating in this manner passes a relatively significant distance, and application of power to the electrodes and thus to the electrical discharge is imprecise, resulting in uneven light, low light, or other irradiance issues. However, narrowing the tube or decreasing the sizes can be an inefficient solution, as the distance traveled and the variances of the arc formed through the distances traveled still tend to result in uneven lighting as discussed below.

Figure 3:
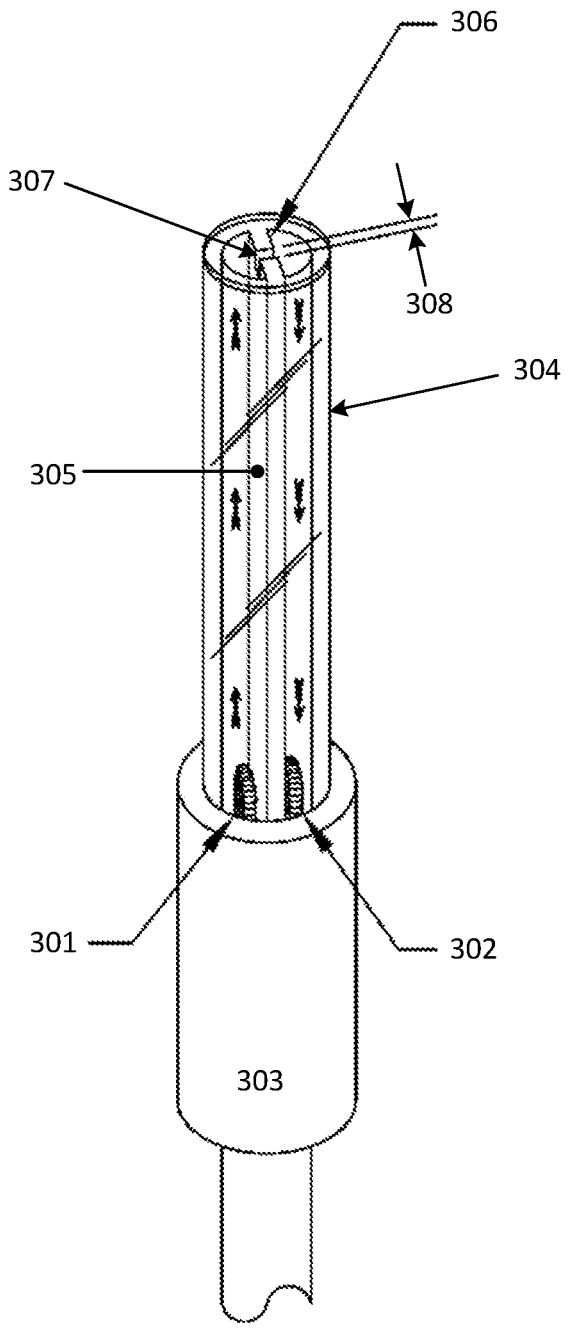
FIG. 3 shows the present design.

The present design is shown in FIG. 3. From FIG. 3, electrode 301 is provided with electrode 302 within base 303. A cylindrical shaped quartz envelope 304 is provided covering the electrodes with an enhanced septum 305 formed therein. The septum 305 again separates electrodes 301 and 302, and the design includes a flat, circular upper or top surface 306 fabricated from magnesium fluoride or any other transparent material. Of note in the configuration of FIG. 3 is the gap 307 formed in the septum 305 and adjacent to top surface 306. Septum 305 notably contacts the inner walls of cylindrical shaped quartz envelope 304 such that no gap exists on either side of the septum 305, and no gap exists between the top of the septum 305 and the top surface 306. Spacing or lateral opening of gap 307 is shown as gap spacing Dimension C 308, representing the area where the arc flows through from one zone to the other.

Thus according to FIG. 3, the overall design has certain similarities to the double-bore lamp design of FIG. 2 including the location of the electrodes as well as the flat top surface of the FIG. 1 design, for example. A septum is employed, albeit a very different septum, namely one that touches all adjacent surfaces, leaving no gap save for the one spall gap provided therein. The travel of the electrical discharge is similar to that shown in FIG. 2, but the presence of the gap concentrates the electrical discharge passing along the path provided and causes a more effective and efficient ignition, and thus a brighter light for a longer amount of time. While electrical discharge within the passageways on either side of septum 305 travels similarly and may be actuated to cause illumination with a level of inefficiency, it is the electrical discharge passing through the gap 307 that provides a beneficial lighting effect.

Figure 4:
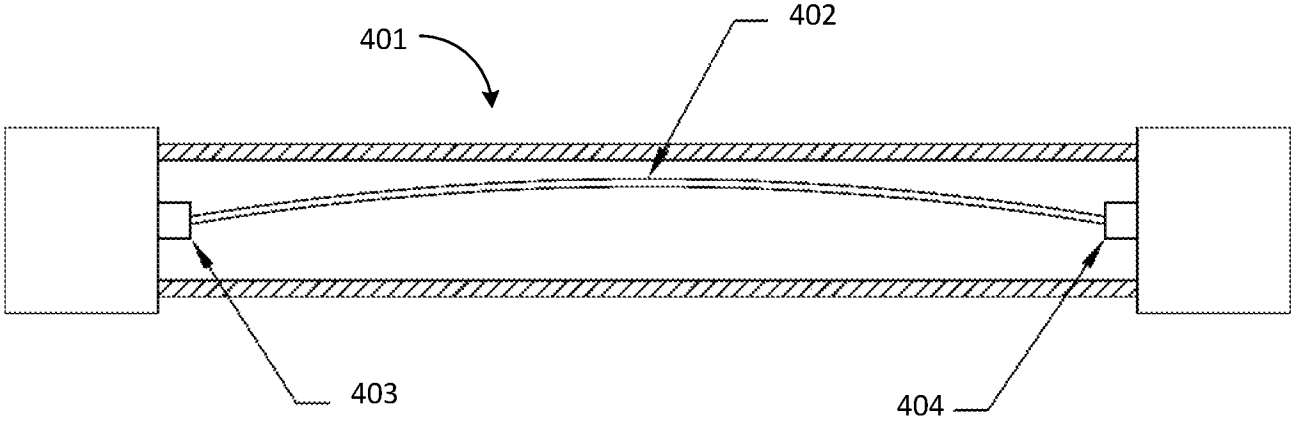
FIG. 4 (Prior Art)
FIG. 4 shows arc behavior in a wide lamp envelope.
Figure 5:
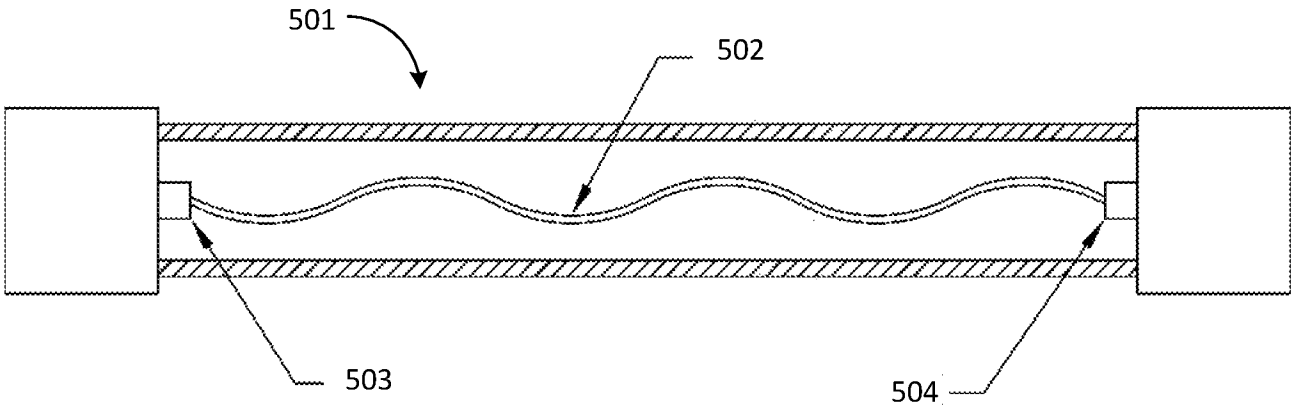
FIG. 5 (Prior Art)
FIG. 5 shows alternate arc behavior in a wide lamp envelope.

FIGS. 4 and 5 illustrate issues with previous designs, in particular the lengthy distance traveled by the arc in such designs. FIG. 4 shows arc behavior in a wide lamp envelope 401 representing a significant deviation of arc 402 from the centerline provided. Electrodes 403 and 404 are provided in this view. The electric arc forms a curve and is not concentric or centrally aligned within the lamp envelope. FIG. 5 shows minor multiple deviations from the centerline, essentially a sinusoidal path traveled by the arc 502 in the lamp envelope 501, with electrodes 503 and 504 shown. Again, this arc is not concentric or centrally or axially aligned within the lamp envelope, which is undesirable. In both of these FIG. 4 and FIG. 5 situations, arcing in this manner tends to produce a less than desirable level of illumination, and the illumination tends to be less efficient than an arc that substantially traces or approximates the centerline of the envelope. In short, minimum deviation from the centerline tends to produce the best results, and the arrangement of FIG. 2, for example, frequently produces arcs similar to those shown in FIGS. 4 and 5.

Figure 6:
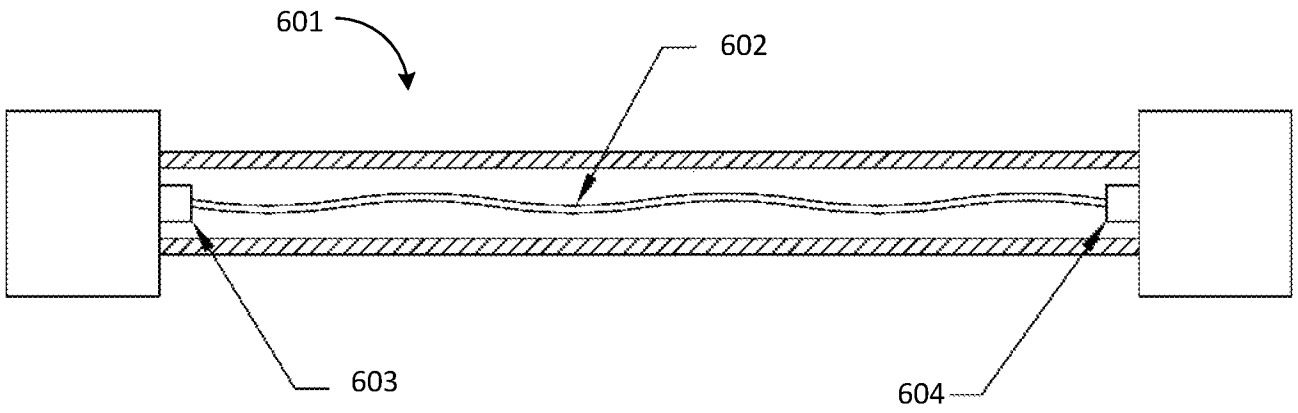
FIG. 6 (Prior Art)
FIG. 6 is arc behavior in a narrow lamp envelope.
Figure 7:
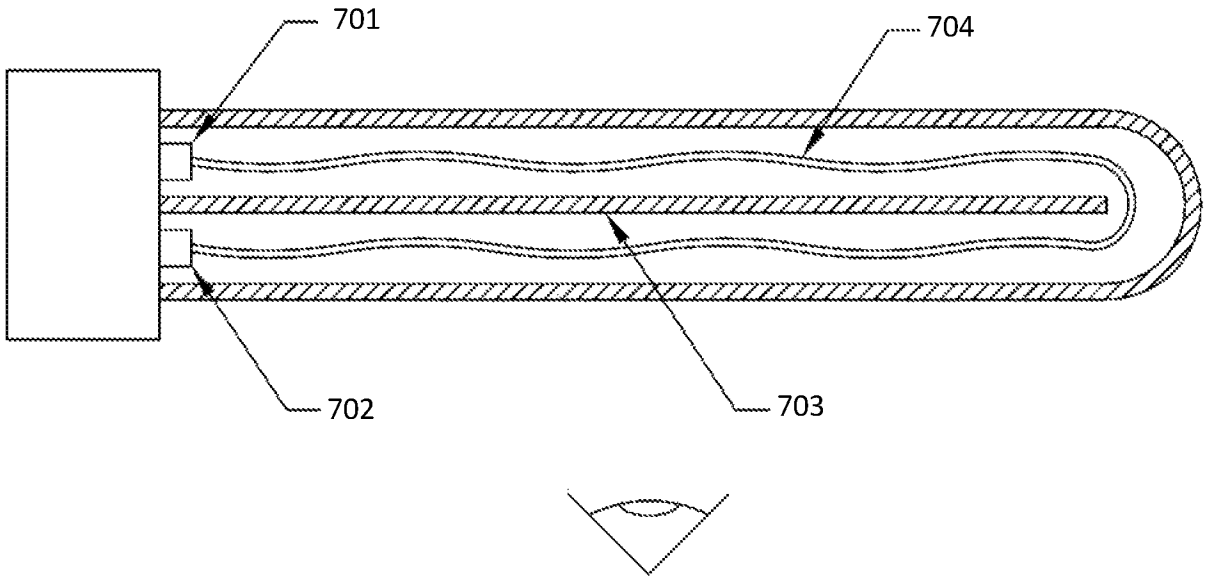
FIG. 7 (Prior Art)
FIG. 7 shows arc behavior in a double-bore lamp.

FIG. 6 shows arc behavior in a narrow lamp envelope 601. While not as dramatic as shown in FIGS. 4 and 5, the arc 602 between electrodes 603 and 604 in FIG. 6 is sinusoidal in nature. Thus as discussed, narrower envelopes tend to improve performance in that less deviation is generally encountered, but such a design still includes certain inefficiencies. FIG. 7 shows a similar phenomenon in a double-bore lamp, wherein narrow openings are provided, electrodes 701 and 702 shown, with septum 703 provided between the electrodes. In this view, even with the narrow passages provided, the arc 704 tends to vary from the desired centerline, in a sinusoidal manner in this representation, potentially producing an inefficient resultant light level.

Figure 9:
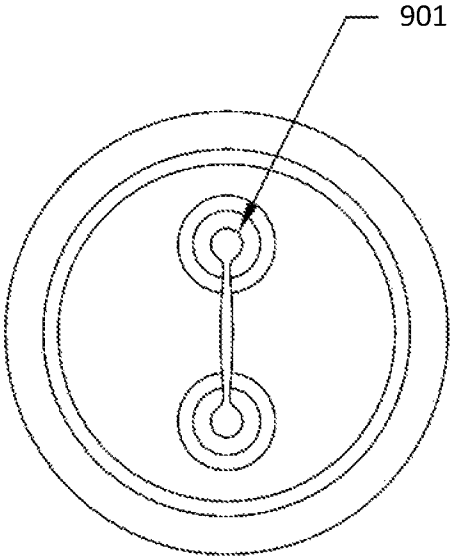
FIG. 9 (Prior Art)
FIG. 9 shows an end view of the representation of FIG. 8.
Figure 8:
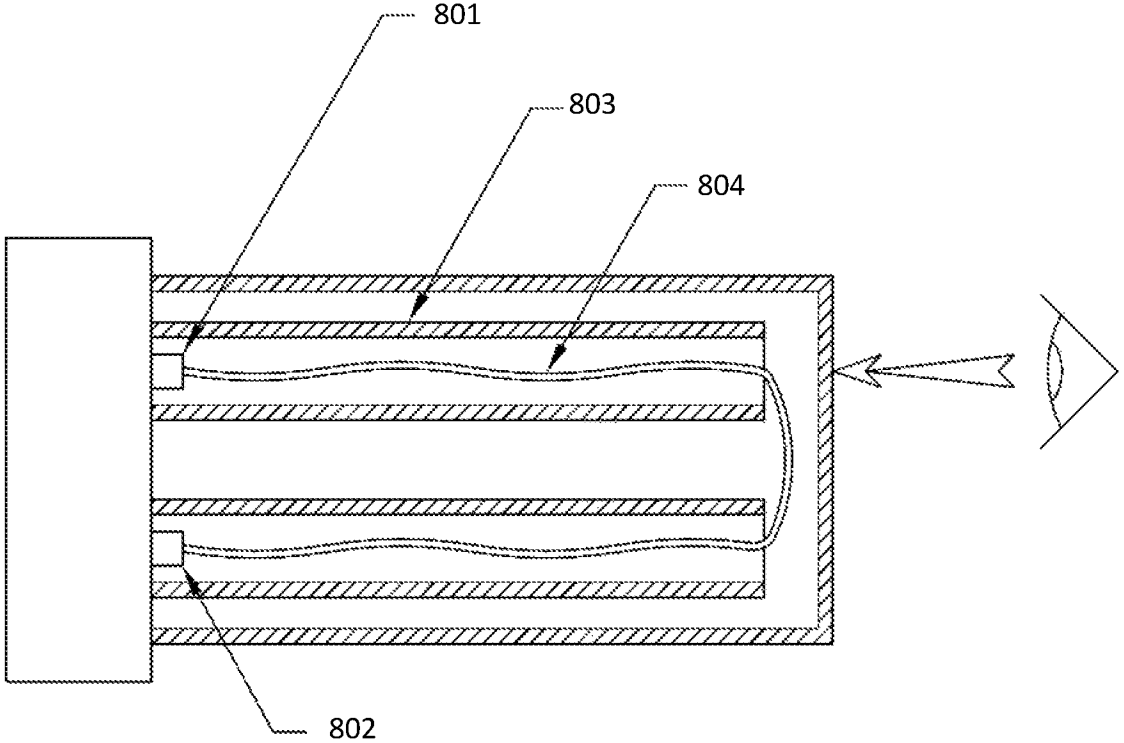
FIG. 8 (Prior Art)
FIG. 8 is an alternate representation of a capillary lamp structure similar to the general structure represented in FIG. 1.

FIG. 8 shows an alternate representation of a capillary lamp structure similar to the general structure represented in FIG. 1. From FIG. 8, electrodes 801 and 802 are provided together with capillary tubes such as capillary tube 803. Arc 804 is formed and tends to be sinusoidal in nature due to the physics of the gas and electricity provided, and arc flows in the path presented. FIG. 9 shows an end view of the representation of FIG. 8, viewed from the right side of FIG. 8, with the arc at the point of the arrow of FIG. 8 indicated by point 901. Arc flows up one capillary tube and down the other in this representation. In general, the arc of FIG. 9 is relatively wide and hence inefficient.

Figure 10:
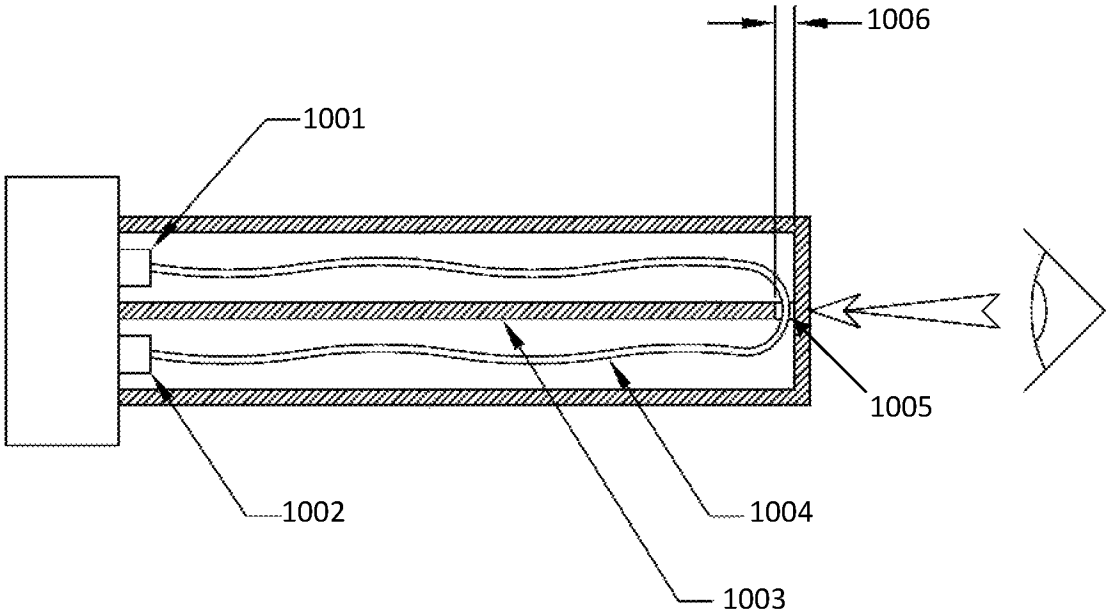
FIG. 10 is a representation of the current design showing arcing.

FIG. 10 is a representation of the current design having electrodes 1001 and 1002 with septum 1003 and arc 1004 produced. While the physical nature of the electricity, gas, and tube formation tends to provide the similar sinusoidal arc effect in this version, the presence of the gap or notch 1005 tends to provide a limited area or region for the arc 1004 to travel, resulting in a relatively bright and stable light source. Dimension 1006 is the depth of the gap or notch 1005.

Figure 11:
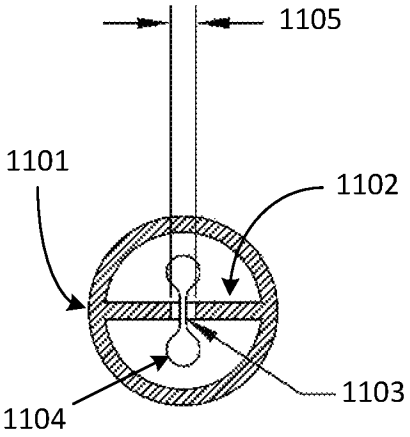
FIG. 11 shows an end view of the design of FIG. 10.

FIG. 11 shows an end view of the design of FIG. 10 with a graphical representation of the arc produced in the current design. The arc of FIG. 11 is smaller than the arc shown passing between capillary tubes in FIG. 9. From FIG. 11, envelope 1101 includes septum 1102 integrally formed with a flat element, not shown in this view, placed on top of the and also yielding no gap except for gap or notch 1103. Size of gap or notch 1103 is shown as space 1105. Arc 1104 passing through gap or notch 1103 tends to be smaller than other arcs provided in the capillary or double-bore gas lamp designs presented, where a narrow or small arc provides a strong, bright, and stable light source. The arc 1104 is concentrated in a narrow area and thus produces stable, bright, high quality lighting.

While shown in the drawings as a gap or opening of particular shape and dimensions, it is to be understood the current design is not so limited, and different shapes and sizes of gaps may be provided while still within the teachings of the present design. For example, but not by way of limitation, a differently shaped square or rectangular gap, or a semicircular or oval or other shaped gap may be provided. Of particular note is the relatively small dimension provided for electrical discharge to pass through and an arc to be formed, thus increasing stability and light production.

The gap or notch in the septum or partition may take different sizes and shapes as discussed. One embodiment is a gap or notch as large as 2 millimeters squared (2 mm2), but may be on the order of 1 millimeter squared or even as small as 0.5 millimeters squared. The gap may be sized based on anticipated size of the arc formed, or may be sized anticipating the size of the arc formed. Such sizing may be determined based on the gas provided, dimensions of the bores or openings formed, electrodes employed, and other relevant factors.

With respect to the specific construction of the device of FIG. 3, different materials may be provided that produce the functionality claimed, but in general, one construction may include a quartz envelope or outer tube with a quartz or magnesium fluoride top window. The components, including the tube and septum, said to be made of quartz may include fused quartz (ozone-producing) or may be ozone free quartz. The envelope or outer tube may be constructed from a single short section of drawn and sealed quartz tubing. The base end of the envelope is crimped, fused or pinched and sealed to the base. The septum may similarly be constructed of quartz or magnesium fluoride. The tube so constructed may employ electrodes of any reasonable construction, such as tungsten and/or molybdenum, and may contain a selected gas and mercury vapor. When electrically connected, normally by plugging into a source of electrical potential, the potential appears across the electrodes causing an electrical arc to be developed and sustained as long as the electrical potential is maintained. The electrical arc is concentrated and directed through the gap in the septum and appears as bright light emission at the gap.

In operation, an electrical discharge path through ionized gas within the region of the lamp proximate to the gap causes emission of light radiation at various wavelengths. If this light radiation is of a short wavelength, as is the case when the ionized gas is mercury vapor, the light will not substantially pass through portions of envelope made of quartz. It will, however, pass through the upper disk if the upper disk is constructed of magnesium fluoride. Because the disk is planar, and because the gaseous discharge path is located immediately inside the gas discharge lamp and near to the top disk, the emitted light will be substantially transmitted through the top magnesium fluoride disk and out of the lamp. Such short wavelength light radiation is particularly useful in instrumentation applications.

The electrical discharge path between the electrodes within the lamp produce ionizing radiation in the form of light because of a production of ions in the gaseous media by the passage of electrical current therethrough. This electrical current, or ionization current, or gas current, is in an amount which is determined by the geometries and dimensions of the electrical discharge path, by the gaseous media through which the electrical discharge transpires, and by the material from which the electrodes are constructed. In the present design, the electrodes may be constructed of any reasonable material that provides the functionality described herein, including but not limited to tungsten and/or molybdenum.

Quartz is relatively inexpensive, and is easily and economically fused, machined, and drawn by conventional processes. The top circular window may be constructed of quartz or magnesium fluoride and is typically flat and of uniform thickness. This flat planar window does not diffuse light emitted from ionized gas within the gas discharge lamp as would occur if the window were curved and/or of varying thickness, acting as a crude lens. While short wavelength light is transmitted from the lamp through the circular disk or window when formed of magnesium fluoride, the ratio of lamp height to lamp diameter is provided to increase the likelihood that light is emitted with low dispersion.

Substantially all of the short wavelength light emission of gas discharge lamp passes through the circular disk. This selective directional emission is not the case for long wavelength light radiation to which cylindrical quartz envelope and the disk is substantially transparent. If the tube is intended to be used for the production of both long and short wavelength light radiation, and if it is also desired that such radiation should be emitted substantially through circular disk, the inside surface of cylindrical envelope and the surface of base member facing the cavity of gas discharge lamp, may, either one or both, be coated with a reflecting material to aid light radiation reflection and transmission. Such a reflectorized coating may be obtained by a vacuum deposition of silver, gold or other reflecting substances to the surfaces.

The detailed method of manufacturing the gas discharge tube may be as follows. A relatively large quartz tube is provided, and a dome fused onto the tube at its distal end. The septum is formed, including the gap, and inserted and fused, on its sides and on top preferably, to the inside of the tube. Both electrodes are provided in the base. A vacuum may then be drawn from the tube ends and all tubes are filled with gas from their ends, specifically a selected gas and mercury vapor which is typically ionized. The tube is subsequently crimped and fused.

When an adequate electrical potential across the electrodes initiates a gas discharge path through the gas of the tube, this path will proceed from electrode to electrode through the gap formed in the septum. The gas discharge path through the end of at least one capillary tube causes a light emission which appears as a bright spot at the location of the lamp end.

Thus according to one aspect of the present design, there is provided a gas discharge lamp comprising an elongate tubular envelope having an integrally formed partition extending axially from one end of the elongate tubular envelope and defining a pair of bores within an interior of the elongate tubular envelope disposed on opposite sides of the partition, a pair of electrodes, with one electrode disposed within each of the pair of bores, and an upper surface disposed at the opposite end of the elongate tubular envelope. Sides of the partition contact the elongate tubular envelope, the partition contacts the upper surface, and the partition comprises a notch formed therein, the notch contacting the upper surface and forming an exclusive passageway between the pair of bores.

According to a further aspect of the present design, there is provided a gas discharge lamp comprising a base, an envelope affixed to the base, the envelope having an integrally formed partition extending axially from one end of the envelope thereby defining a pair of bores on opposite sides of the partition within an interior of the envelope, two electrodes, the two electrodes disposed on each side of the partition, and an upper surface affixed to an end of the envelope opposite the base. Sides of the partition contact the envelope, the partition contacts the upper surface, and the partition comprises a notch formed therein, the notch contacting the upper surface and forming an exclusive gas passageway between the pair of bores.

According to another aspect of the present design, there is provided a gas discharge lamp comprising a base, a closed top cylindrical envelope fixedly mounted to the base, the closed top cylindrical envelope comprising an integrally formed partition defining a pair of openings on opposite sides of the partition, and two electrodes positioned proximate the base, each electrode on an opposite side of the partition. Sides of the partition contact the closed top cylindrical envelope and the partition comprises a notch formed proximate an upper edge of the partition thereby establishing an exclusive gas passageway between the pair of openings.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. A gas discharge lamp comprising:

an elongate tubular envelope having an integrally formed partition extending axially from one end of the elongate tubular envelope and defining a pair of bores within an interior of the elongate tubular envelope disposed on opposite sides of the partition;

a pair of electrodes, with one electrode disposed within each of the pair of bores; and an upper surface disposed at the opposite end of the elongate tubular envelope;

wherein sides of the partition contact the elongate tubular envelope, the partition contacts the upper surface, and the partition comprises a notch formed therein, the notch contacting the upper surface and forming an exclusive passageway between the pair of bores.

2. The gas discharge lamp of claim 1 wherein the upper surface is formed of a material substantially transparent to short wavelength light.

3. The gas discharge lamp of claim 2 wherein the material comprises magnesium fluoride.

4. The gas discharge lamp of claim 1 wherein the electrodes are formed of material from the group consisting of tungsten and molybdenum.

5. The gas discharge lamp of claim 3 wherein the elongate tubular envelope is formed of quartz.

6. The gas discharge lamp of claim 1 wherein the notch is smaller than 2 millimeters squared.

7. The gas discharge lamp of claim 1 wherein the notch is smaller than 1 millimeter squared.

8. A gas discharge lamp comprising:

a base;

an envelope affixed to the base, the envelope having an integrally formed partition extending axially from one end of the envelope thereby defining a pair of bores on opposite sides of the partition within an interior of the envelope;

two electrodes, the two electrodes disposed on each side of the partition; and an upper surface affixed to an end of the envelope opposite the base;

wherein sides of the partition contact the envelope, the partition contacts the upper surface, and the partition comprises a notch formed therein, the notch contacting the upper surface and forming an exclusive gas passageway between the pair of bores.

9. The gas discharge lamp of claim 8 wherein the upper surface is formed of a material substantially transparent to short wavelength light.

10. The gas discharge lamp of claim 9 wherein the material comprises magnesium fluoride.

11. The gas discharge lamp of claim 8 wherein the two electrodes are formed of material from the group consisting of tungsten and molybdenum.

12. The gas discharge lamp of claim 10 wherein the envelope is formed of quartz.

13. The gas discharge lamp of claim 8 wherein the notch is smaller than 2 millimeters squared.

14. The gas discharge lamp of claim 8 wherein the notch is smaller than 1 millimeter squared.

15. A gas discharge lamp comprising:

a base;

a closed top cylindrical envelope fixedly mounted to the base, the closed top cylindrical envelope comprising an integrally formed partition defining a pair of openings on opposite sides of the partition; and two electrodes positioned proximate the base, each electrode on an opposite side of the partition;

wherein sides of the partition contact the closed top cylindrical envelope and the partition comprises a notch formed proximate an upper edge of the partition thereby establishing an exclusive gas passageway between the pair of openings.

16. The gas discharge lamp of claim 15 wherein the two electrodes are formed of material from the group consisting of tungsten and molybdenum.

17. The gas discharge lamp of claim 16 wherein the closed top cylindrical envelope is formed of quartz.

18. The gas discharge lamp of claim 15 wherein the notch is smaller than 2 millimeters squared.

19. The gas discharge lamp of claim 15 wherein the notch is smaller than 1 millimeter squared.

20. The gas discharge lamp of claim 15 wherein the closed top cylindrical envelope comprises a gas that facilitates arcing between the two electrodes.

* * * * *